US007371955B2

(12) United States Patent
Takegawa

(10) Patent No.: US 7,371,955 B2
(45) Date of Patent: May 13, 2008

(54) DRUM TUNING KEY

(75) Inventor: Akito Takegawa, Chiba (JP)

(73) Assignee: Pearl Musical Instrument Co., Chiba (JP)

( * ) Notice: Subject to any disclaimer, the term of this patent is extended or adjusted under 35 U.S.C. 154(b) by 134 days.

(21) Appl. No.: 11/358,008

(22) Filed: Feb. 22, 2006

(65) Prior Publication Data

US 2007/0193433 A1 Aug. 23, 2007

(51) Int. Cl.
*G10D 13/00* (2006.01)
*G10G 7/00* (2006.01)

(52) U.S. Cl. ..... 84/458; 84/413; 84/422.1; 84/422.4

(58) Field of Classification Search ..... 84/413, 84/458, 422.1, 422.4
See application file for complete search history.

(56) References Cited

U.S. PATENT DOCUMENTS 151,797 A * 6/1874 Rawson ..... 84/411 R
1,437,252 A * 11/1922 Kinnaird ..... 16/422
1,970,409 A * 8/1934 Wiedemann ..... 81/30
2,132,105 A * 10/1938 Gladstone ..... 84/411 R
2,256,478 A * 9/1941 Hill ..... 73/862.21
2,482,909 A * 9/1949 Hertz ..... 81/24
3,531,808 A * 10/1970 McCue ..... 7/138
3,810,411 A * 5/1974 Schambacher ..... 84/477 B
4,091,664 A * 5/1978 Zerver ..... 73/862.21
4,195,837 A * 4/1980 Poulin ..... 473/298
4,208,942 A * 6/1980 Henrit ..... 84/421
4,287,806 A * 9/1981 Neary ..... 84/458
4,320,688 A * 3/1982 Donohoe ..... 84/422.4
4,570,522 A 2/1986 May
4,822,052 A * 4/1989 Dimmick et al. ..... 473/285
4,870,883 A 10/1989 Gauger
4,879,158 A * 11/1989 Horiki et al. ..... 428/159
4,903,569 A 2/1990 Kurosaki
5,044,250 A * 9/1991 Beyer ..... 84/422.4
5,058,891 A * 10/1991 Takeuchi ..... 473/201
5,145,171 A * 9/1992 Head et al. ..... 473/300
5,193,418 A * 3/1993 Behrenfeld ..... 81/121.1
5,209,089 A * 5/1993 Nelson ..... 70/456 R
D346,100 S * 4/1994 Behrenfeld ..... D8/21
5,361,671 A * 11/1994 Genna ..... 84/422.4

(Continued)

OTHER PUBLICATIONS

Image of Tama drum key.

(Continued)

*Primary Examiner*—Lincoln Donovan
*Assistant Examiner*—Robert W Horn
(74) *Attorney, Agent, or Firm*—Berenato, White & Stavish

(57) ABSTRACT

A drum tuning key comprises a handle portion, a barrel portion defining an axis connected to the handle portion, the barrel portion having internal walls defining a cavity extending inwardly along the axis from an end of the barrel portion, the cavity being square in cross section and adapted to turn a drum tension rod. The tuning key further comprises an indicator member removably disposed on at least one of the handle portion and the barrel portion. The indicator member may comprises a single plug member removably disposed on said handle portion, or a pair of plug members disposed on opposite lateral ends of said handle portion. The plug members may be different colors, different materials, and/or different hardness to enhance the assembly and tuning operation as well as pitch adjustment.

13 Claims, 3 Drawing Sheets

U.S. PATENT DOCUMENTS 5,369,555 A * 11/1994 McKain et al. ..... 362/578
D366,996 S * 2/1996 Torres ..... D8/29
5,689,076 A * 11/1997 Usuda ..... 84/458
D404,986 S 2/1999 Mahon
D407,895 S 4/1999 Staley
6,122,788 A * 9/2000 Bulcock ..... 7/146
6,170,361 B1 * 1/2001 Yates ..... 81/15.7
6,242,680 B1 6/2001 Benton, Jr.
6,449,789 B1 * 9/2002 Krass et al. ..... 7/143
D472,114 S 3/2003 Palecki et al.
6,629,901 B2 * 10/2003 Huang ..... 473/549
6,653,541 B1 * 11/2003 Minker ..... 84/422.4
6,681,791 B1 * 1/2004 Chorney et al. ..... 137/15.01
6,752,051 B2 * 6/2004 Hu ..... 81/475
6,792,831 B2 * 9/2004 Crosser ..... 81/119
6,978,503 B2 * 12/2005 Del Cogliano ..... 7/143
7,013,516 B1 * 3/2006 Peters ..... 7/146
7,034,216 B2 * 4/2006 DiPietro ..... 84/411 R
7,152,511 B2 * 12/2006 Fen ..... 81/177.1
7,244,882 B1 * 7/2007 Colwell ..... 84/312 R
7,272,998 B1 * 9/2007 Gauthier ..... 81/473
2004/0244563 A1 * 12/2004 Calato ..... 84/422.4
2005/0056137 A1 3/2005 Dipietro
2005/0188795 A1 * 9/2005 Woltz ..... 81/57.36
2007/0180875 A1 * 8/2007 Byrne ..... 70/401
2007/0193433 A1 * 8/2007 Takegawa ..... 84/413

OTHER PUBLICATIONS

Image of Evans drum key.
Image of drum workshop.

* cited by examiner

DRUM TUNING KEY

BACKGROUND OF THE INVENTION

1. Field of the Invention

The invention relates generally to tuning key for musical instruments and particularly to a drum tuning key that enhances the tuning assembly procedure for percussion instruments.

2. Description of Related Art

Percussion instruments are traditional instruments that have taken many forms over the years. The most familiar of the percussion instruments are drums and cymbals. Percussion instruments are used in symphony orchestras to play classical music, as well as in small musical groups and bands to play popular music.

The typical arrangement of percussion instruments for musical groups or bands is a compact arrangement of several drums and cymbals. The cymbals are often arranged on stands where they can be manipulated by drum sticks or brushes, or by foot pedals.

Most drums in a percussion unit are tuned by varying the drum head tension to have an effect on the sound produced. The drum head is attached to a ring that is connected in several places to tightening screws or tension rods that in turn are threadedly connected to mountings on the drum body. Turning these tension rods varies the tension of the drum head and turning the tension rods at different locations on the ring has different effects on the sound produced on the drum. Occasionally each tension rod has a turning handle of its own. But more often, because of the number of tuning screws on a drum, perhaps a dozen or more, the tuning screws end in a square-shaped head with which a tuning key is used. The drum tuning key has a square-shaped hole to match the square-shaped cross section of the tuning screw head. The drum tuning key is slid on the turning tension rod head, the screw is turned, and the key is removed.

The drum tuning key is small and portable; it can easily be lost. Keeping the drum tuning key available can be a serious problem. The key can of course be attached in some way to the instrument, but then it has to be released in order to use it. It can also detract from the appearance of the instrument to which it is attached, or at least require elaborate efforts to make its attachment to the drum simple and attractive.

Likewise, the traditional tuning key does not indicate the degree of tuning; i.e., the number of turns, for a particular instrument.

The need therefore exists for a tuning key that need not be attached to a drum but is readily available for use. The need also exists for a tuning key with indicating means for assessing the number of turns for a particular tuning screw in a manner that is attractive, inexpensive to make, and easy to use and maintain.

SUMMARY OF THE INVENTION

A drum tuning key comprises a handle portion, a barrel portion defining an axis connected to the handle portion, the barrel portion having internal walls defining a cavity extending inwardly along the axis from an end of the barrel portion, the cavity being square in cross section and adapted to turn a drum tension rod. The tuning key further comprises an indicator member removably disposed on at least one of the handle portion and the barrel portion. The indicator member may comprises a single plug member removably disposed on said handle portion, or a pair of plug members disposed on opposite lateral ends of said handle portion. The plug members may be different colors, different materials, and/or different hardness to enhance the assembly and tuning operation as well as pitch adjustment.

DETAILED DESCRIPTION OF THE PREFERRED EMBODIMENT

Figure 1:
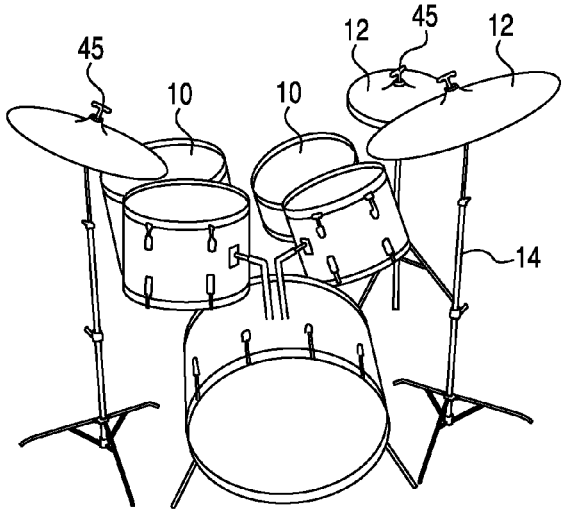
FIG. 1 is a perspective view of an arrangement of typical percussion instruments for a band.

FIG. 1 shows a typical arrangement of percussion instruments for a small band, designed for maximum operation by one person. A cluster of drums 10 of different types form the center of the arrangement, and cymbals 12 are arranged on stands 14 at the periphery. To a certain extent it is an arrangement of assembled instruments. The cymbals 12, for example, may be disassembled from the stands 14 and the drums 10 may be disassembled from connection to each other.

Figure 2:
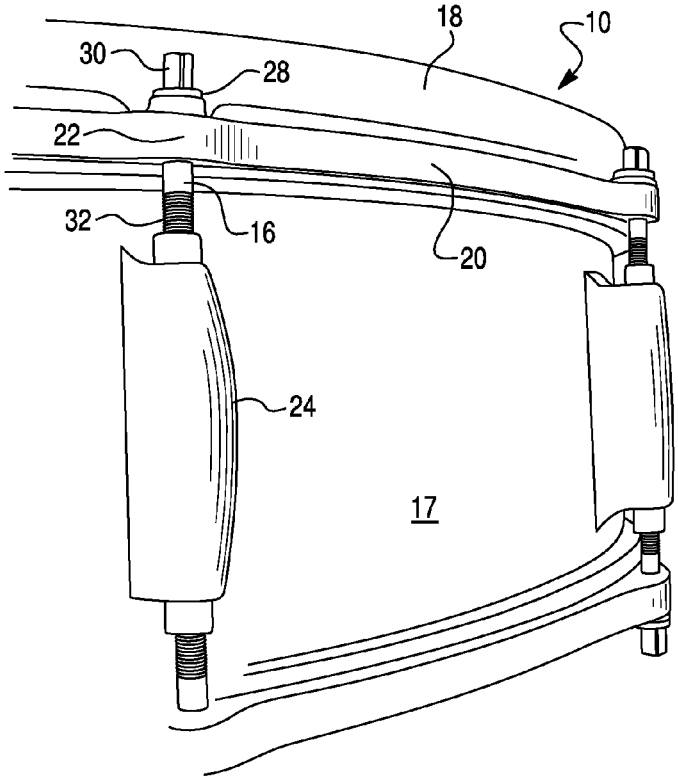
FIG. 2 is a detailed perspective view of the tuning unit on a drum.

FIG. 2 shows, in detail, a typical arrangement for tunable drums 10, whereby the drums 10 are tuned by tightening or loosening threaded screws 16 defining tension rods. The drum head 18 is attached to a ring 20. The ring 20 has holes 22 at several points through which the threaded screws 16 pass to be threadedly connected to mountings 24 on the drum body 17. Each screw 16 has a collar 28 beyond which has a projecting head 30 with a square cross-section. It is rotatably mounted in the ring hole 22, its threaded portion 32 threadedly connected to the mounting. Turning the square-shaped projecting head 30 moves the threaded end 32 of the screw (tension rod) 16 in or out of the mounting 24, pulling down or releasing the pressure on the ring 20 and hence on the drum head 18. This and other similar drum tuning arrangements are conventional and well known to those skilled in the art.

Figure 3:
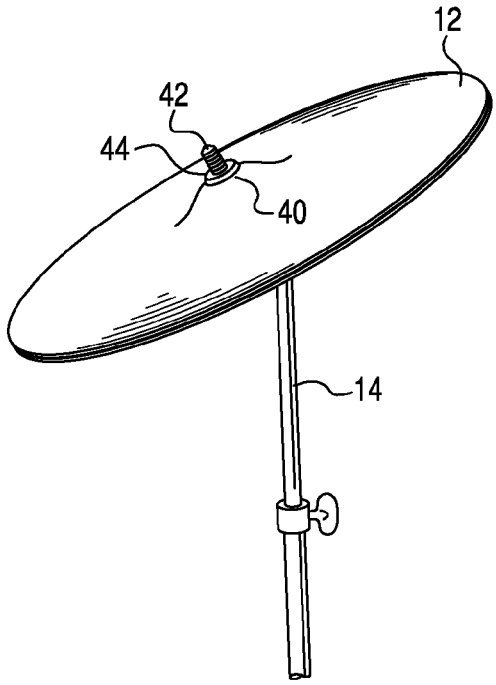
FIG. 3 is a detailed perspective view of the end of a cymbal stand.
Figure 4:
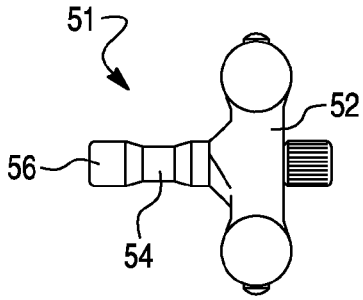
FIG. 4 is an elevation view of a drum tuning key according to the instant invention.

FIG. 3 shows the mounting, or securing, arrangement for a cymbal 12. The cymbal 12 has a hole 40 in its center and is applied over the threaded end 42 of a typical cymbal stand 14. A rubber grommet 44 may be used. A wing nut 45 (see FIG. 1) is threadedly secured to the projecting end 42 to secure the cymbal 12 in place.

Figure 5:
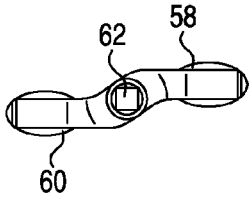
FIG. 5 is a bottom view of the tuning key of FIG. 4.
Figure 6:
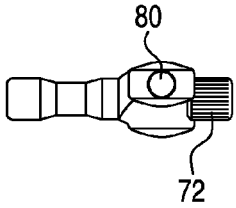
FIG. 6 is a side view of the tuning key of FIG. 4.
Figure 7:
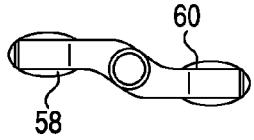
FIG. 7 is a top view of the tuning key of FIG. 4.

The drum tuning key 51 of the invention is shown in the next four views, FIGS. 4-7. The drum tuning key 51 is preferably an integral piece of metal that may be finished in chrome to enhance its attractiveness. Its general shape is that of a T. The T-shape consists of a turning handle 52 attached at its central portion transversely to a shank 54 leading to a bottom barrel portion 56. As shown in FIGS. 5 and 7, the handle 52 may be curved to fit the fingers more comfortably when the tool is being rotated in the clockwise direction since the tightening direction, clockwise, usually requires more pressure by the fingers. Therefore the extending portions of the handle 52 are curved slightly to meet the thumb at the surface 58 and curved to meet the other fingers at the surface 60 in a comfortable concave shape when the tool 51 is grasped to turn it in the clockwise direction.

The turning handle 52 of drum key 51 according to this invention preferably is formed with weighted ends to allow the key 51 to maintain momentum when spinning to more quickly loosen or tighten tension rods.

The barrel portion 56 of the tool has an internal elongate cavity 62 that is square-shaped in cross section and extends inwardly along the barrel axis from the end of the barrel. In the typical tool 51 the width of the cavity 62 might be about ¼ of an inch. The length of the cavity 62 would likely be in that case about ½ of an inch. The outside dimension, or diameter, of the barrel 56 would be about ⅜ of an inch. The cross section of the cavity 62 conforms to the square-shaped head 30 of the drum tuning screws 16. The dimensions are such that it may slidably mate with the head 30 easily yet seat firmly to turn the screw 16.

In use, the drum key 51 is slid over the square shaped tuning screw head 30 and turned clockwise to tighten the drum head 18 at that particular location, or counterclockwise to loosen it. The tool 51 can be used on successive tensioning rods 16, or, if desired, several tools can be used at the same time at different locations.

The tool 51 can be used, of course, with square-shaped tensioning rod heads 30 and but the invention should be construed to encompass any mating arrangement between the tuning key and the associated connectors for drums and cymbals. That is, the shape and dimensions of the heads 30 of the tension rods 16 are chosen to mate with the barrel cavity 62 of the tuning key 51.

The drum tuning key 51 of this invention may also be further provided with a plunger-type, quick release connector assembly 70 that allows the tuning key 51 to be connected to a strap, key ring, necklace, bracelet, etc. For example, the tuning key 51 can be worn around a player's neck with a strap, chain etc. to provide ease of use and access. The preferred embodiment of the connector assembly comprises a male portion 72 that either securely fits into a recess 74 provided in the handle 52 or is integrally formed as part of the handle 52. A ring member 76 has a male plunger portion that snap fits into the plunger 72 to provide a quick release assembly. See FIG. 8. Plunger 72 is preferably knurled to provide a better grip when using plunger 72 as a means to spin the key quickly using a finger-snapping motion for quick attachment/removal of tension rods, etc.

Figure 8:
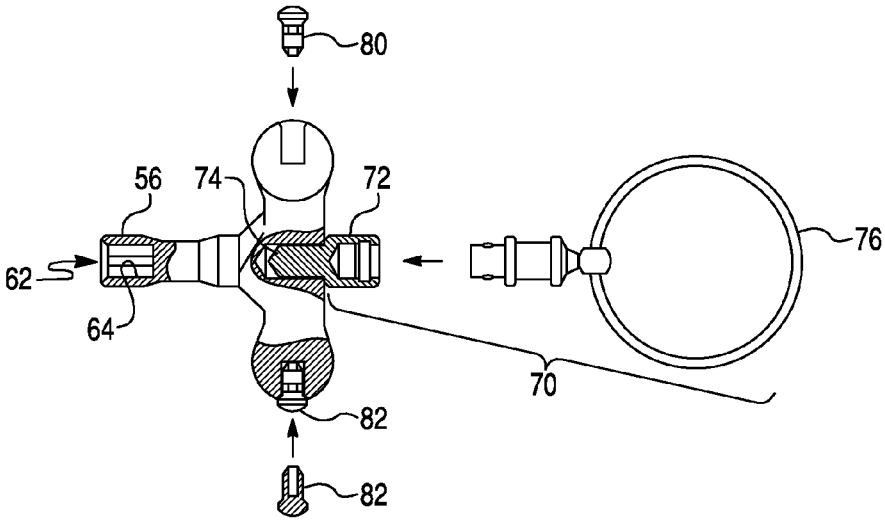
FIG. 8 is a cross-sectional and partially exploded view of the key of FIG. 4.

Further, the instant invention provides at least one indicator/tuning plug that provide a visual indication of the number of turns made using the tuning key 51 as well as a chosen surface to test the pitch of a drum head. With reference to FIG. 8, the drum tuning key 51 comprises at least one plug 80, 82 disposed at lateral ends of the legs of the tuning handle 52. The plug(s) 80, 82 are preferably removable and replaceable.

With the unique features of this invention, the tuning key 51 may be conveniently used to tap the drum head to hear and test the pitch of the drum head. The plug(s) 80, 82 may be chosen and interchanged to provide a particular surface that promotes testing (i.e., hearing) the pitch accurately. Different materials and surfaces/hardnesses may define the plug(s) 80, 82 to accommodate testing of different drum head types. Typically, a user taps the end of a drum stick to test the pitch of a drum head, but this process is limited to the single material defining the drum stick. The interchangeable plug(s) 80, 82 enhance the tuning operation by the user.

Likewise, different colored plugs 80, 82 may be used to determine the number of times the tuning key 51 has been turned. For example, if one end of the key is outfitted with a white plug and the other end is outfitted with a yellow plug, the user may count the number of times, for example, the yellow plug passes a reference mark of the users choosing to determine how many turns the user has made. This number can then be matched when the user is turning a different tension rod 16. The tuning key 51 may therefore be sold as a kit with a plurality of plugs 80, 82 having different colors and materials to provide a different appearance and hardness to facilitate and enhance the tuning process.

While the foregoing invention has been shown and described with reference to preferred embodiments, it will be understood that various changes in form and detail may be made therein without departing from the spirit and scope of the invention as set forth by the following claims.

The invention claimed is:

1. A drum tuning key, comprising:

a handle portion, a barrel portion defining an axis connected to said handle, said barrel portion having internal walls defining a cavity extending inwardly along said axis from an end of said barrel, the cavity being sized and dimensions to mate with a drum tension rod, an indicator member removably disposed on a terminal end of said handle portion, wherein said indicator member comprises a plug member having a rounded surface that projects from said handle portion for striking a drum head, and wherein said indicator member is chosen from a particular material different from said handle portion to facilitate testing of a pitch for said drum head.

2. The drum tuning key according to claim 1, wherein said indicator member comprises a pair of plug members disposed on opposite lateral ends of said handle portion.

3. The drum tuning key according to claim 2, wherein said pair of plug members is different colors to indicate a number of turns of the tuning key.

4. The drum tuning key according to claim 2, wherein said pair of plug member are different materials.

5. The drum tuning key according to claim 2, wherein said pair of plug member are different hardnesses to facilitate testing of drum pitch.

6. The drum tuning key according to claim 1, wherein said indicator member is colored to facilitate identifying a number of turns of said tuning key made by a user.

7. The drum tuning key according to claim 1, wherein said indicator member comprises a first plug member removably disposed on said handle portion.

8. The drum tuning key according to claim 7, further comprising a series of interchangeable plug members that are used to selectively replace said first plug member during one of a tuning operation and testing of pitch for a drum head.

9. The drum tuning key according to claim 1, wherein the handle portion is arranged transversely to said axis of said barrel portion to form a T-shaped tool.

10. The drum tuning key according to claim 1, wherein the handle portion is integrally formed with said barrel portion.

11. The drum tuning key according to claim 1, further comprising a quick release connector assembly that allows the tuning key to be connected to one of a strap, chain, key ring, and necklace to provide ease of use and access.

12. The drum tuning key according to claim 11, wherein said connector assembly comprises a male plunger that fits into a recess provided in the handle and a ring member attached to the plunger to provide a quick release assembly.

13. The drum tuning key according to claim 11, wherein said connector assembly comprises a male plunger integrally formed with the handle and a ring member attached to the plunger to provide a quick release assembly.

* * * * *